United States Patent [19]
Hårding et al.
[11] 3,958,710
[45] May 25, 1976

[54] BOTTLE CAP WITH GASKET

[75] Inventors: Sune Hårding, Bromma; Per-Åke Andersson, Linkoping, both of Sweden

[73] Assignee: Aktiebolaget Wicanders Korkfabriker, Stockholm, Sweden

[22] Filed: Nov. 12, 1973

[21] Appl. No.: 414,789

Related U.S. Application Data

[63] Continuation-in-part of Ser. No. 132,520, April 8, 1971, abandoned.

[30] Foreign Application Priority Data

Apr. 14, 1970 Sweden ..... 5044/70

[52] U.S. Cl. ..... 215/254; 215/349
[51] Int. Cl. ..... B65d 41/42; B65d 53/04
[58] Field of Search ..... 215/250, 253, 254, 258, 215/348, 349, 350

[56] References Cited

UNITED STATES PATENTS

| | | | |
|---|---|---|---|
| 2,068,444 | 1/1937 | Breckenridge | 215/254 |
| 3,130,056 | 4/1964 | Taylor et al. | 215/254 |
| 3,199,705 | 8/1965 | Brockett | 215/254 |
| 3,216,602 | 11/1965 | Koll | 215/254 |
| 3,276,613 | 10/1966 | Bozek | 215/254 |
| 3,301,426 | 1/1967 | Kavalus | 215/254 |
| 3,310,192 | 3/1967 | Edwards et al. | 215/254 |
| 3,397,661 | 8/1968 | Allman et al. | 215/254 |

FOREIGN PATENTS OR APPLICATIONS

| | | | |
|---|---|---|---|
| 1,032,401 | 6/1966 | United Kingdom | 215/254 |

*Primary Examiner*—William I. Price
*Assistant Examiner*—Stephen Marcus
*Attorney, Agent, or Firm*—Brumbaugh, Graves, Donohue & Raymond

[57] ABSTRACT

A bottle cap is disclosed having a pair of spaced score lines extending across the top of the cap and across a peripheral depending skirt to the edge. A sealing element is bonded to the surface of the inside of the cap. The bonded interface between the sealing element and the cap extends across portions of each of the score lines away from a downwardly depending tear-off flap. The bonded interface serves to prevent tearing of the score lines when the cap is removed. The sealing element is undamaged when the cap is removed so that the cap may be reused.

6 Claims, 3 Drawing Figures

BOTTLE CAP WITH GASKET

This is a continuation-in-part of application Ser. No. 132,520 filed Apr. 8, 1971, now abandoned.

The invention relates to bottle caps, and more particularly, to tear-off bottle caps of the reusable type having a bottle sealing element bonded to the cap so as not to be damaged when the cap is removed from the bottle.

BACKGROUND OF THE INVENTION

Many different types of manually removable bottle caps have been known heretofore. Such caps include tear tabs of various designs, as well as sealing elements bonded to the undersurface of the top of the cap. In general, however, removal of these prior types of tear-off bottle caps results in tearing or damaging of the sealing element. Thus, such caps permanently lose utility after the initial tearing, and therefore are not reusable.

It is well recognized that the tear tab serves as a lever arm so that during the tearing operation, forces tending to pull the cap from the bottle are exerted along the top surface of the cap. In the early stages of the tearing operation, the skirt grips the bottle so that the force exerted by the tear tab acts to tear the cap along the score lines. As the cap is torn, however, the grip of the skirt on the bottle is relaxed. When the grip of the skirt is relaxed enough, the cap is lifted from the bottle neck.

In the prior bottle caps, where the sealing material is bonded to the cap, the seal must be broken to permit release of the cap. Accordingly, such prior caps may not be reused since the broken seal would not retain even a dust free closure.

The few bottle caps utilized heretofore which do have a capability of being reused, generally employ a detachable seal element which is held against the bottle opening by the cap. When the cap is torn off, the seal element must be retained and separately placed over the bottle opening prior to reuse of the cap. This aspect of these prior caps complicates their use and frequently increases their cost.

SUMMARY OF THE INVENTION

It is one object of the present invention to provide a reusable bottle cap which is simple to operate and inexpensive to manufacture.

Another object of the present invention is to provide a reusable bottle cap in which the sealing material is undamaged during removal of the bottle cap.

These and other objects have been achieved by the present invention which includes a reusable tear-off bottle cap in which the sealing element is bonded to a portion of the inside surface of the top of the cap along each one of a pair of score lines traversing the cap. The bonded interface between the sealing element and the cap is preferably within an area remote from the tear tab and extending for not more than one-half of the width of the top of the cap.

DESCRIPTION OF THE DRAWINGS

For a further understanding of the present invention reference may be had to the accompanying drawings, in which.

BRIEF DESCRIPTION OF THE PREFERRED EMBODIMENTS

Figure 1:
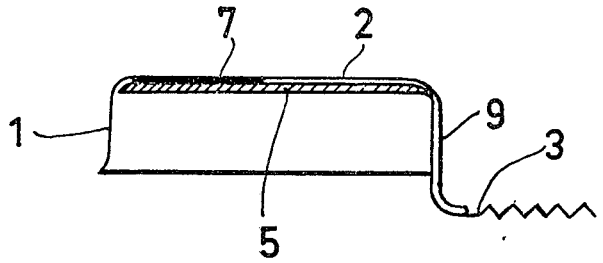
FIG. 1 is a cross-sectional view of a cap of the present invention.
Figure 2:
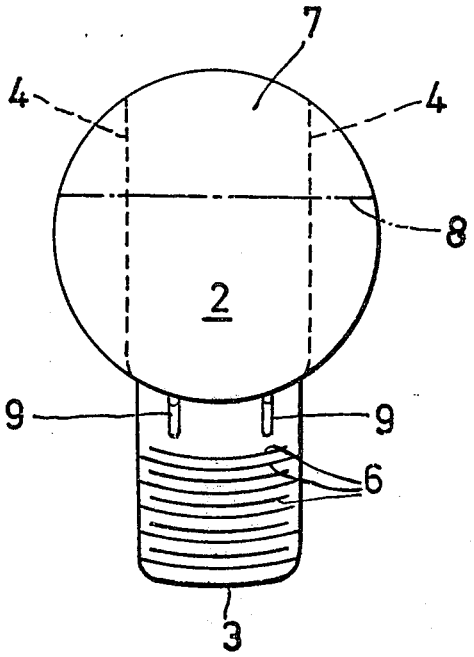
FIG. 2 is a plan view from beneath the cap of FIG. 1.
Figure 3:
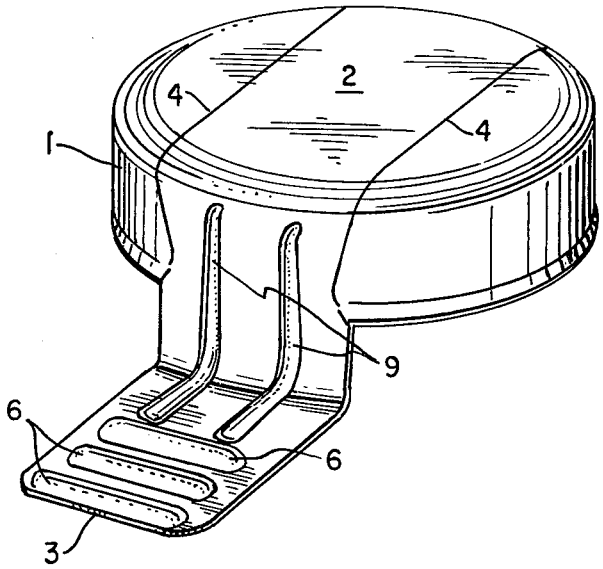
FIG. 3 is a perspective view of the cap of FIG. 1.

Referring now to the drawing, the bottle cap includes a substantially planar top wall portion 2 having an annular depending skirt 1 and an integral tear tab 3 protruding downwardly beneath the lower edge of the skirt and away from the cap. The tear tab 3 may be corrugated, as indicated by reference numeral 6, to facilitate manual gripping of the tab when the cap is removed.

The top wall portion 2 is provided with a pair of spaced substantially parallel tear-off indications, or perforated score lines 4 which extend longitudinally across the top of the cap from the lower edge of the skirt 1 to the tear-off flap 3. The perforations 4 may be formed in any manner known to those skilled in the art, such as by pressing a rolling cutter on a blank of metal. Because the perforations extend completely across the cap, it is possible merely to roll the score lines on a blank of metal and then punch out the cap from the blank. Such a process is fast and inexpensive. Upon lifting of the tear tab 3, the breakthrough of the cap follows along the score lines.

In accordance with the invention, the cap is provided with a sealing element 5 adapted to fit over the opening in the bottle when the cap is in position on the bottle. The sealing element is bonded, through the use of a suitable bonding agent, to the undersurface of the top wall portion 2 of the cap within an area such as indicated by reference numeral 7. The area 7 extends across both score lines 4 and is preferably no less than halfway across the cap from the tear tab 3. The extent of the bonded interface between the sealing element and the undersurface of the top wall of the cap may be varied, as desired. However, any such bonded interface overlies portions of each of the score lines 4.

It is important to note that the sealing element 5 is not bonded to the cap in the immediate vicinity of the tear tab 3. Thus, the cap may be torn along the score lines 4 up to the bonded interface between the sealing element and the wall 2 without damaging the sealing element.

In the preferred embodiment, the score lines 4 are torn during removal of the cap for at least one-half of the cap before reaching the bonded interface. Since the wall 2 is preferably divided over not less than half its length as a result of the tearing along the score lines, the grip on the bottle by the skirt 1 is substantially weakened. At this point any further pulling on the tab 3 tends to remove the cap from the bottle rather than to tear the cap through the bonded interface. This is because the bonded area across the score lines 4 is not torn as easily as the score lines. Thus, further pulling on the tab 3 against the bonded interface causes the application of an additional torque to the cap. Where the grip of the skirt 1 on the bottle is weakened as a result of the tearing of the cap along the score lines, this additional torque tends to remove the cap from the bottle.

Since the sealing element 5 is permanently fastened to the cap, it is lifted from the bottle along with the cap without being damaged. The cap and the sealing element may be replaced over the bottle mouth to provide at least a substantially dust proof seal.

To ensure that the tab 3 is capable of initiating the break up of the cap along the score lines 4, it is provided with a plurality of impressions 9 formed from the inside outwardly in the shape of an elongated rib. Preferably, the ribs 9 extend generally upwardly along the skirt 1 of the cap to the transition point between the skirt and the wall 2. The ribs 9 must not extend inwardly over the wall 2, since this would jeopardize the seal against the bottle opening.

In one embodiment of the present invention, the sealing element 5 is in the form of a disk having a diameter corresponding to that of the opening of the bottle. The disk may be formed in several ways, including forming the disk in situ, for example by spraying a seal forming composition against the undersurface of the wall 2 and bonding such material to the wall only at points traversing both score lines remote from the tear tab 3. The unbonded portion of the seal detachably abuts the undersurface of the wall 2 in the vicinity of the tear tab.

The actual material or composition used to bond the sealing element to the cap is not an essential or critical feature of the invention. Any suitable adhesive or bonding agent may be applied between the sealing element and the disk to fasten them together. Preferably the bonding area 7 is located not more than halfway along the length of the wall 2 as measured from points on the periphery of the cap substantially diametrically opposite the points of transition between the tab 3 and the wall 2.

What is claimed is:

1. A cap for a container having a neck defining an opening, said cap comprising an upper wall to overlie the opening and having a peripherally depending skirt to engage the neck to secure the cap in position over the opening, a pair of spaced score lines on said wall defining a tear portion, and a sealing element including a portion covering the opening and bonded to part of the inside surface of said wall and across each of said score lines no more than half-way between opposite edges of said wall from one of said edges.

2. The cap of claim 1 wherein the bond between said sealing element and said wall comprises an adhesive.

3. The cap of claim 2 in which the bonded interface between said sealing element and said wall is continuous across both of said score lines.

4. The cap of claim 1 in which said score lines traverse the skirt and said tear portion includes a tab projecting away from the cap from between said score lines substantially at the other of said edges.

5. The cap of claim 4 in which said sealing element comprises a disk and said part of said inside wall surface is at least halfway across said wall from said tab.

6. The cap of claim 1 in which said score lines are substantially parallel to each other.

* * * * *